US011833554B2

(12) United States Patent
Song et al.

(10) Patent No.: US 11,833,554 B2
(45) Date of Patent: Dec. 5, 2023

(54) SYSTEMS AND METHODS FOR DISRUPTION OF BIOFILM AND ALGAL GROWTH

(71) Applicant: UNIVERSITY OF HOUSTON SYSTEM, Houston, TX (US)

(72) Inventors: Gangbing Song, Pearland, TX (US); Siu Chun Michael Ho, Sugar Land, TX (US); Devendra Patil, Houston, TX (US)

(73) Assignee: UNIVERSITY OF HOUSTON SYSTEM, Houston, TX (US)

( * ) Notice: Subject to any disclaimer, the term of this patent is extended or adjusted under 35 U.S.C. 154(b) by 0 days.

(21) Appl. No.: 17/980,185

(22) Filed: Nov. 3, 2022

(65) Prior Publication Data

US 2023/0054218 A1 Feb. 23, 2023

Related U.S. Application Data

(62) Division of application No. 16/494,409, filed as application No. PCT/US2018/023249 on Mar. 20, 2018, now abandoned.

(60) Provisional application No. 62/474,810, filed on Mar. 22, 2017.

(51) Int. Cl.

| | |
|---|---|
| ***B08B 3/12*** | (2006.01) |
| ***B08B 17/02*** | (2006.01) |
| ***B06B 1/06*** | (2006.01) |
| ***B63B 59/04*** | (2006.01) |
| ***E02B 17/00*** | (2006.01) |
| ***E02D 31/06*** | (2006.01) |

(52) U.S. Cl.

CPC ..... *B08B 3/12* (2013.01); *B06B 1/0618* (2013.01); *B08B 17/02* (2013.01); *B63B 59/04* (2013.01); *E02B 17/0026* (2013.01); *E02D 31/06* (2013.01); *B06B 2201/74* (2013.01)

(58) Field of Classification Search

None

See application file for complete search history.

(56) References Cited

U.S. PATENT DOCUMENTS

2010/0126942 A1* 5/2010 Thottathil ..... C02F 1/36 310/317

FOREIGN PATENT DOCUMENTS

WO WO-0158750 A1 * 8/2001 ..... B63B 59/04

* cited by examiner

*Primary Examiner* — Nicole Blan

(74) *Attorney, Agent, or Firm* — Jackson Walker LLP

(57) ABSTRACT

Systems and methods for the ultrasonic disruption of biofilm and algae growth on underwater structures utilize an ultrasonic actuator that produces a natural frequency in the ultrasonic range. In some embodiments, the ultrasonic actuator includes one or more piezoelectric transducers.

4 Claims, 2 Drawing Sheets

SYSTEMS AND METHODS FOR DISRUPTION OF BIOFILM AND ALGAL GROWTH

This application is a divisional of and claims priority to U.S. patent application Ser. No. 16/494,409 filed Sep. 16, 2019, which is a 371 of International application No. PCT/US2018/023249 filed Mar. 20, 2018, which claims priority to U.S. Provisional Patent Application No. 62/474,810, entitled "Systems and Methods for Disruption of Biofilm and Algal Growth," filed Mar. 22, 2017, the entire contents of which are hereby incorporated by reference.

BACKGROUND

This disclosure pertains to the disruption of subsea biofilm and algal growth.

The subsea environment, coupled with the surfaces and warmth provided by subsea structures, is conducive to the growth of algae and formation of biofilms. While subsea structures are designed to withstand most mechanical loads and perform within specifications for long periods of time, certain structures are still vulnerable to degradation from marine fouling/biofouling. Fouling/biofouling includes the formation of biofilms and, later, the growth of algae and increasing complex organisms on the surface of a subsea structure. This interrupts the normal function of the structure, such as a connection or a communication port.

FIG. 1 shows a representation of the various stages of fouling. Stage 1 represents initial attachment, Stage 2 is irreversible attachment, Stage 3 is Growth I, Stage 4 is Growth II, and Stage 5 is Outbreak. Growth of algae on subsea structures may cause range of problems with the function of subsea systems, including anything from covering of remote operated vehicle (ROV) control terminals to corrosion of pipelines. Fouling of underwater structures is problem that extends past the oil and gas industry and affects any industry that has marine-related activities. Methods to prevent such growth have been proposed, including parts with moving components and sleeves with special growth-inhibiting skins. Specific examples include a scraping ring, antifouling polymer, and sharkskin.

SUMMARY

The present disclosure relates generally to the use of ultrasonic excitation of the structural surface to prevent fouling. Studies have been reported on the effects of ultrasound on the growth of biofilms and algae, but none were performed directly in the context of the environment that is found in the subsea oil and gas industry. The present disclosure relates to ultrasonic inhibition of biofilm and algae growth against microbial species and under conditions that are applicable to those of the subsea oil and gas industry, as well as other industries. The method and system do not use moving parts and can be low cost.

The present system and method for disruption of biofilm and algae growth utilize one or more ultrasonic actuators that produce a natural frequency in the ultrasonic range. The natural frequency is adjustable to fit different applications. The ultrasonic actuator is placed in close proximity to the underwater structure in need of protection from biofouling.

In some examples the ultrasonic actuator can include a piezoelectric transducer. A piezoelectric transducer is a transducer that converts electrical charges produced by solid materials into energy. Piezoelectric ultrasonic transducers generate ultrasonic activity, producing sound waves above the frequencies that can be heard by humans. It rapidly expands and contracts when an appropriate electrical frequency and voltage is applied. The expansion and contraction cause its ultrasonic diaphragm, with is the pressure-sensing element of the transducer, to vibrate. This introduces ultrasonic activity into the area around the transducer. Piezoelectric ultrasonic transducers produce high electroacoustic efficiency while minimizing heat generation. Piezoelectric ultrasonic transducers are typically made of piezoelectric ceramic.

DETAILED DESCRIPTION OF PREFERRED EMBODIMENTS

The present disclosure relates to systems and methods for the disruption of biofilm and algae growth on underwater structures.

Figure 1:
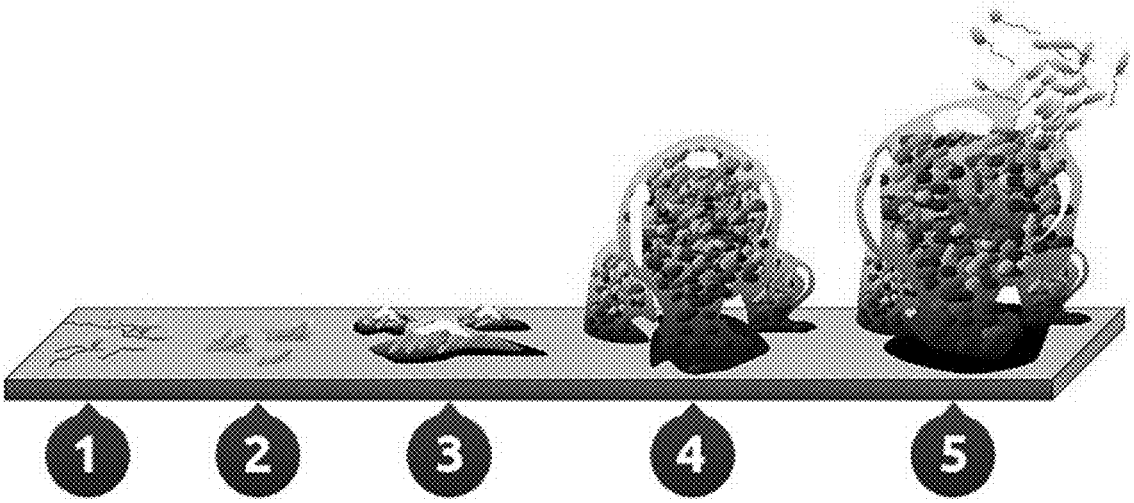
FIG. 1 shows a diagram of the stages 1-5 of fouling (Monroe 2007).
Figure 2:
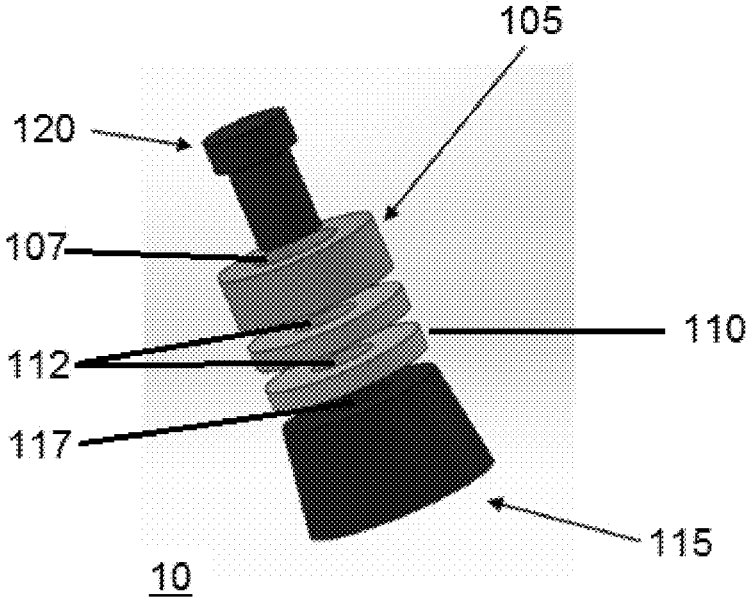
FIG. 2 shows an ultrasonic actuator in accordance with preferred embodiments disclosed herein.

A system for the disruption of biofilm and algae growth on an underwater structure surface may include one or more ultrasonic actuators. FIG. 2 shows a preferred embodiment of an ultrasonic actuator 10. The ultrasonic actuator 10 in this preferred embodiment is composed generally of a back mass 115, front mass 105, one or more piezoelectric transducers 110, and a preloader 120, as shown in FIG. 2. The front mass 105 and back mass 115, which are located on front and back sides of the piezoelectric transducers, respectively, in addition to providing some protection to the piezoelectric transducers 110, are used to design the natural frequency of the assembly. Natural frequency is dependent on the structural stiffness and mass. The natural frequency can be adjusted to fit applications, such as in this case for algae and biofilm disruption. Typically, the natural frequency is in the ultrasonic range. The preloader 120, which can be in the shape of a bolt, connects and applies compression to the masses 105 and 115 and the piezoelectric transducers 110 as a further measure of protection, since the piezoelectric transducer 110 generally cannot withstand much tension. Thus by applying an adequate amount of load, the transducer 110 will always operate under a compressed state. In the embodiment shown in FIG. 2, the front mass 105 is generally circular and has a front receiving portal 107, the piezoelectric transducers 110 are generally circular and have transducer receiving portals 112, and the back mass is generally circular and has a back receiving portal 117, all for receiving and securing the preloader 120, which may have a generally cylindrical shape.

In preferred embodiments, the piezoelectric transducers, the front mass, the back mass, the back receiving portal, and the preloader can have any suitable shape. Piezoelectric actuators are manufactured in many different shapes and include those that may be described as generally circular, plate-like, or hollow cylindrical. The piezoelectric crystal can be made into any suitable shape. Similar shapes can also be stacked together to magnify the motion of the ultrasonic actuator.

Figure 3:
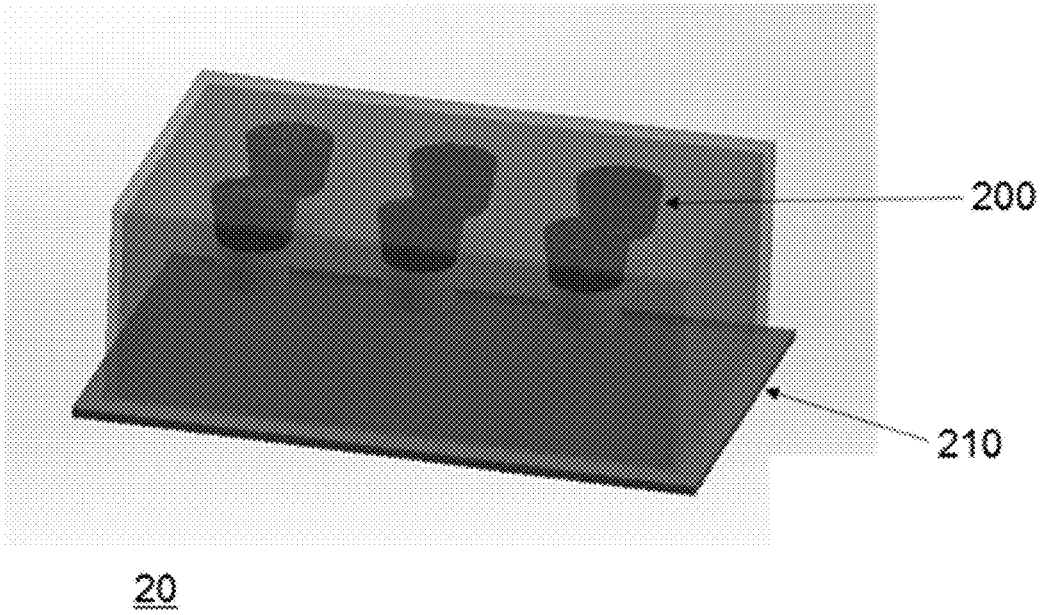
FIG. 3 shows an enclosed array of actuators in accordance with preferred embodiments disclosed herein.
Figure 4:
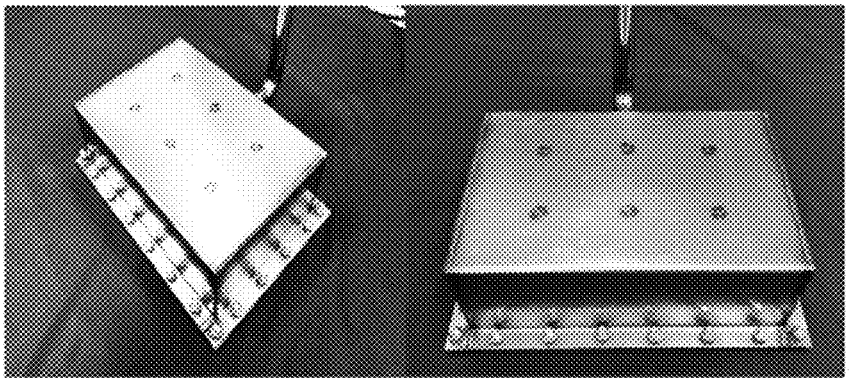
FIG. 4 shows photographs of an enclosed array of six actuators within a waterproof enclosure in accordance with preferred embodiments disclosed herein.

In order to protect against water, in additional preferred embodiments the actuator 10 from FIG. 2 should be encapsulated. FIG. 3 shows an array of actuators 20 including multiple (in this example, six) ultrasonic actuators 200. In FIG. 3, these ultrasonic actuators 200 are arranged in a pattern in order to cover a larger area than is possible by a single actuator. The enclosure 210 shown in FIG. 3 surrounds and protects the ultrasonic actuators 200 from water. The enclosure 210 may simulate the control panel of a subsea wellhead or any suitable arrangement applied to any number of applications. FIG. 4 shows photos of a completed prototype containing six actuators within a waterproof enclosure.

The system for disruption of biofilm and algal growth should have the one or more ultrasonic actuators placed in proximity to the underwater structure surface on which the biofilm and algae growth is to be disrupted. The distance should be close enough to allow the surface to receive the ultrasonic frequency produced by the ultrasonic actuators.

EXAMPLES

An algae incubator system to simulate subsea conditions can be constructed. The incubator will have space to house various subsea pipeline components and various key environmental parameters and can be actively controlled, including temperature, lighting, and currents/waves. By changing the water through a water pump, the salinity of the water in the incubator can also be changed.

Small metallic components can then be placed within the incubator along with a species of microbes and algae that are common pests in the subsea oil and gas industry. Through adjusting the incubator parameters, the algae can be encouraged to form colonies on the surface of the testing components. In order to test the effects of ultrasound, water proofed ultrasonic actuators containing piezoelectric transducers (PZTs) can then be installed on the component to generate ultrasonic vibrations. The following properties of the PZT installation and vibration excitation can be tested: frequency, power, and distance (i.e., the distance of the actuator from a colony on the surface or across a distance of water). The viability and growth rate of biofilms and algae can be tested by varying these properties. The effect can be assessed through visual inspection and through cell counting methods. The control experiment will be done in parallel in which a component will be placed in an incubator without ultrasound disturbance. Other experiments in which ultrasound is introduced at different stages of fouling will also be carried out. The results from can then be used to optimize actuator placements to maximize the inhibition of biofilm and algae growth on actual subsea components.

An ultrasonic disruption system to inhibit biofilm and algae growth can be utilized to disrupt the growth of microbes and algae in the algae incubator system, and its design can be optimized based on data showing favorable excitation frequency and placement of ultrasonic actuators based on algae growth rate.

REFERENCES

The following documents and publications are hereby incorporated by reference.

wikipedia.org/wiki/Biofouling

Do, C. N. (1991). U.S. Pat. No. 5,040,923. Washington, DC: U.S. Patent and Trademark Office.

Nicholson, J. A., Eccles, G. B., & Love, D. H. (2012). U.S. Pat. No. 8,091,647. Washington, DC: U.S. Patent and Trademark Office.

Nihiser, B. A. (2014). *Evaluation Of The Applications Of A Biomimetic Antifouling Surface (Sharklet™) Relative To Five Other Surfaces To Prevent Biofilm Growth In Freshwater Aquaponics Systems* (Doctoral dissertation, Ohio University).

Francko, D. A., Taylor, S. R., Thomas, B. J., & McIntosh, D. (1990). Effect of low-dose ultrasonic treatment on phystological variables in *Anabaena flos-aquae* and *Selenastrum capricornutum*. *Biotechnology letters,* 12(3), 219-224.

Ahn, C. Y., Park, M. H., Joung, S. H., Kim, H. S., Jang, K. Y., & Oh, H. M. (2003). Growth inhibition of cyanobacteria by ultrasonic radiation: laboratory and enclosure studies. *Environmental science & technology,* 37(13), 3031-3037.

Hao, H., Wu, M., Chen, Y., Tang, J., & Wu, Q. (2004). Cyanobacterial bloom control by ultrasonic irradiation at 20 kHz and 1.7 MHz. *Journal of Environmental Science and Health, Part A,* 39(6), 1435-1446.

Zhang, G., Zhang, P., Liu, H., & Wang, B. (2006). Ultrasonic damages on cyanobacterial photosynthesis. *Ultrasonics sonochemistry,* 13(6), 501-505.

Bixler, G. D., & Bhushan, B. (2012). Biofouling: lessons from nature. *Philosophical Transactions of the Royal Society of London A: Mathematical, Physical and Engineering Sciences,* 370(1967), 2381-2417.

Yamamoto, K., King, P. M., Wu, X., Mason, T. J., & Joyce, E. M. (2015). Effect of ultrasonic frequency and power on the disruption of algal cells. *Ultrasonics sonochemistry,* 24, 165-171.

Monroe, D. "Looking for Chinks in the Armor of Bacterial Biofilms." *PLoS Biology* 5 (11, e307) 2007.

What is claimed is:

1. A method for disruption of biofilm and algae growth on a surface of a structure, comprising:

installing one or more ultrasonic actuators on the surface of the structure, wherein the one or more ultrasonic actuators comprise:

one or more piezoelectric transducers, wherein the one or more piezoelectric transducers have a front side and a back side and wherein the one or more piezoelectric transducers are adapted to produce an ultrasonic frequency, wherein the ultrasonic frequency is a natural frequency of the structure, and wherein the natural frequency of the structure is dependent upon structural stiffness and mass, a front mass located on the front side of the one or more piezoelectric transducers, a back mass located on the back side of the one or more piezoelectric transducers, a preloader, wherein the preloader connects and applies compression to the front mass, the one or more piezoelectric transducers, and the back mass, and an enclosure encapsulating the one or more piezoelectric transducers, the front mass, the back mass, and the preloader to produce a waterproof enclosure for the one or more ultrasonic actuators;

producing an ultrasonic frequency using the one or more ultrasonic actuators;

generating vibrations on the surface of the structure, wherein the vibrations are caused by the ultrasonic frequency produced by the one or more piezoelectric transducers; and disrupting biofilm and algae growth on the surface of the structure.

2. The method of claim 1, wherein the one or more piezoelectric transducers have a circular shape and comprise transducer receiving portals, wherein the front mass is circular in shape and comprises a front receiving portal, wherein the back mass is circular in shape and comprises a back receiving portal, wherein the preloader has a cylindrical shape, and wherein the preloader passes through the front receiving portal, the transducer receiving portals, and the back receiving portal.

3. The method of claim 1, wherein more than one ultrasonic actuator is installed on the surface.

4. The method of claim 1, wherein the structure is an underwater structure.

* * * * *